US006985124B1

(12) United States Patent
Nogawa

(10) Patent No.: US 6,985,124 B1
(45) Date of Patent: Jan. 10, 2006

(54) DOT MATRIX DISPLAY DEVICE

(75) Inventor: Masashi Nogawa, Suita (JP)

(73) Assignee: Texas Instruments Incorporated, Dallas, TX (US)

( * ) Notice: Subject to any disclaimer, the term of this patent is extended or adjusted under 35 U.S.C. 154(b) by 153 days.

(21) Appl. No.: 09/689,104

(22) Filed: Oct. 12, 2000

(30) Foreign Application Priority Data

Oct. 12, 1999 (JP) ..... 11-289207

(51) Int. Cl.
*G09G 3/20* (2006.01)

(52) U.S. Cl. ..... 345/55; 345/82; 345/84

(58) Field of Classification Search ..... 345/55, 345/76, 82, 84, 93; 368/83
See application file for complete search history.

(56) References Cited

U.S. PATENT DOCUMENTS 3,696,393 A * 10/1972 McDonald ..... 345/82
5,719,589 A * 2/1998 Norman et al. ..... 345/209

FOREIGN PATENT DOCUMENTS

JP 11-161219 6/1999

* cited by examiner

*Primary Examiner*—Jimmy H. Nguyen
(74) *Attorney, Agent, or Firm*—William B. Kempler; W. James Brady, III; Frederick J. Telecky, Jr.

(57) ABSTRACT

To improve the display quality in the scanning of a dynamic drive system by effectively preventing the erroneous display of the display elements that are connected to the scanning electrodes during non-selection. The erroneous lighting cancel circuit 20 has a number of (or assemblies of) dummy diodes MD used for erroneous lighting prevention that is equal to the number of common lines CL, and along with the anode of each dummy diode MD0, MD1, MD2, MD3 being electrically connected to each corresponding common line CLO, CL1, CL2, CL3 by means of suitable wiring, the cathode of each dummy diode MD0, MD1, MD2, MD3 is electrically connected to a terminal of a reference potential (for example, ground potential) through the medium of a shared switch 22 and a constant current source circuit (active load) 24. The control signal SG reaches an active state (H level) only for a prescribed time during the scanning drive period for each horizontal scanning period, and the switch 22 is placed in the ON state. During this prescribed time, the positive charge that is present on each common line CLO, CL1, CL2, CL3 is discharged at a constant current to the ground side through the medium of each dummy diode MD0, MD1, MD2, MD3, the ON state of the switch 22, and the constant current source circuit 24.

15 Claims, 4 Drawing Sheets

DOT MATRIX DISPLAY DEVICE

FIELD OF THE INVENTION

This invention relates to a dot matrix display device in which the display elements for one dot portion are arrayed in a matrix form, and in particular, relates to a dot matrix display device with a dynamic drive system that conducts the display of images by driving display elements one row at a time in a selective matrix configuration with a prescribed scanning system within a period for one frame.

BACKGROUND OF THE INVENTION

In FIG. 7, the basic construction of a dynamic drive type dot matrix display device is shown. In this display, along with the common lines CL0, CL1, CL2, CL3 that extend in the horizontal direction as scanning electrodes arranged at a fixed pitch in the vertical direction, the signal lines RL0, RL1, RL2, RL3 that extend in the vertical direction as signal electrodes are arranged at a fixed pitch in the horizontal direction, and LEDs (light emitting diodes) are arranged with the anodes connected to the common lines CL) and the cathodes connected to the signal lines RL, respectively, as display elements at each intersection point of a matrix.

The common lines CL0, CL1, CL2, CL3, are electrically connected to the terminal of the positive polarity power supply voltage VBB through the medium of the switches K0, K1, K2, K3, respectively. On the other hand, the signal lines RL0, RL1, RL2, RL3, are electrically connected to the ground terminal through the medium of the switches F0, F1, F2, F3 and the fixed current source circuits (active loads) J0, J1, J2, J3, respectively.

Within one frame cycle, the common lines CL0, CL1, CL2, CL3 are driven (supplied electricity) by the power supply voltage VBB in a time division manner by means of selective control of the switches K0, K1, K2, K3. Normally, the common lines CL0, CL1, CL2, CL3 are driven (supplied electricity) by the power supply voltage VBB for a constant period (horizontal scanning period) sequentially and selectively from top to bottom according to a line sequence scanning. Then, in each horizontal scanning period, the switches F0, F1, F2, F3 are turned ON for just the time responding to the respective corresponding signals (for example, the gradation signals that designate the gradations of the pixels), and one line portion of the LEDi0, LEDi1, LEDi2, LEDi3 that are connected to the selected common line CLi emit light by conducting a prescribed current for just the ON time of each corresponding switch F0, F1, F2, F3.

As mentioned above, theoretically, the display device becomes an assembly wherein only the LEDi0, LEDi1, LEDi2, LEDi3 on the one line of the common lines CLi that has been selected emit light at one time. But, in this type of display used in the past, there are instances LEDj1, LEDj2, LEDj3 on other common lines CLj that have not been selected are caused to emit undesired erroneous lighting.

An explanation will be given for the cause of the above-mentioned erroneous lighting phenomenon based on the abbreviated model of FIG. 8. This model is a minimum 2×2 matrix, and a display pattern is assumed wherein only the LED00 and LED11 on the diagonal line are caused to repeatedly light, and the other LED01 and LED10 are maintained in the extinguished state. In this case, the non-display LED01, LED10 equivalently function as condensers Cap01, Cap10.

In the first horizontal scanning period, K0=ON, K1=OFF, F0=ON, F1=OFF and LED00 is lit, and LED01 (Cap01) is charged. Here, at the LED01 (Cap01), the common line (CL0) on the anode side is supplied with electricity by the power supply voltage VBB, and the signal line SL1 on the cathode side is placed in a floating state. Because of this, all the negative electrical charge that is present on the signal line RL1 is collected at the cathode electrode of the LED01 (Cap01), and the LED01 (Cap01) is charged by just that collected charged quantity. The voltage between the anode and cathode of the LED01 (Cap01) at this time, in other words, the charging voltage (Vcap), is determined by means of this charging load quantity. Since the anode electrode of the LED01 (Cap01) becomes the same as the potential of the power supply voltage VBB, the potential of the cathode electrode of the LED01 (Cap01), in other words, the potential VRL1 for the signal line RL1 is VRL1=VBB−Vcap.

Next, in the second horizontal scanning period, K0=OFF, K1=ON, F0=OFF, F1=ON and LED11 is lit, and LED10 (Cap10) is charged. The LED00 is extinguished, and temporarily (while extinguished) can be viewed as a condenser. LED01 (Cap01) becomes a problem at this time. Due to the fact that the switch F1 is closed, the negative charge that accumulated at the cathode electrode of the LED01 (Cap01) is shifted to the ground through the signal line SL1. On the other hand, because the switch K0 is open, the positive charge that has accumulated at the electrode of the LED01 (Cap01) dies out through a DC escape path. Because of that, the potential difference Vcap between the two electrodes of the LED01 (Cap01) suddenly increases, and the LED01 that was equivalent to a condenser up until then conducts and lights. As expected, when the Vcap drops below the threshold value for the LED01, the conduction (lighting) stops. In any case, during the second horizontal scanning cycle, the LED01 that originally should not light erroneously lights with capacitance noise being the cause, without relationship to the signal.

In the first horizontal scanning period, the LED10 that was originally not supposed to light is caused to emit an erroneous lighting in the same manner as mentioned above. This type of erroneous lighting is weak compared to the normal lighting condition, but is recognizable to the human eye, and is a problem with respect to the quality of the display.

An aspect of this invention was achieved by referring to the above-mentioned problem points, and an object is to offer a dot matrix display device in which the erroneous display of display elements that are connected to a scanning electrode during non-selection in the scanning of the dynamic drive system is effectively prevented, so the display quality is improved.

SUMMARY OF THE INVENTION

In order to achieve the above-mentioned object, the dot matrix display device of one aspect of this invention is a dot matrix display device wherein multiple lines of scanning electrodes and multiple lines of signal electrodes are arranged interlacing in a matrix form, and in which the display elements at each intersecting point of the matrix are driven by means of a voltage between the above-mentioned scanning electrodes and the above-mentioned signal electrodes, and is a construction wherein rectifying elements are electrically connected in the direction of a prescribed polarity between the above-mentioned scanning electrodes and a reference voltage terminal that applies a prescribed reference potential, and the load on the above-mentioned scanning electrodes is discharged to the above-mentioned reference voltage terminal side through the medium of the above-mentioned rectifying elements.

In another aspect of the dot matrix display device of this invention, preferably, in addition to the above-mentioned basic construction, it can be further equipped with switches that are connected in series with the above-mentioned rectifying elements between the above-mentioned scanning electrodes and the above-mentioned reference voltage terminal, and a switch control means that places the above-mentioned switches in the ON state only for a prescribed time during a period in which the drive voltage is supplied to the above-mentioned scanning electrodes.

Also, in addition to the above-mentioned basic construction, it can be provided with a scanning electrode drive means that sequentially drives with a prescribed reference drive voltage the above-mentioned plurality of scanning electrodes at a constant horizontal scanning cycle, a signal electrode drive means that drives the above-mentioned multiple lines of signal electrodes in response to the respective corresponding signals at each cycle of the above-mentioned horizontal scanning, switches that are connected in series with the above-mentioned rectifying elements between the above-mentioned scanning electrodes and the above-mentioned reference voltage terminal, and a switch control means that places the above-mentioned switches in the ON state only in a prescribed time during the scanning drive period for each horizontal scanning period.

Also, it can be constructed by additionally having a constant current circuit that is connected in series with the above mentioned rectifying elements between the above-mentioned scanning electrodes and the above-mentioned reference voltage terminal. Also, in the event light emitting diodes are used in the above-mentioned display elements, it can also be a construction in which a portion of the above-mentioned display elements function as the above-mentioned rectifying elements.

REFERENCE NUMERALS AND SYMBOLS AS SHOWN IN THE DRAWINGS

10 Dot matrix display panel

12 Controller

14 Scanning electrode driver

16 Signal electrode driver

18 Image signal processing circuit

20 Erroneous lighting cancel circuit

22 Switch

24 Constant current source circuit

MD0, MD1, MD2, MD3. Dummy diode

30 Erroneous lighting cancel circuit

32 DC power supply

B0, B1, B2, B3. Buffer circuit

DESCRIPTION OF EMBODIMENTS

Below, embodiments of this invention are explained based on FIGS. 1–6.

Figure 1:
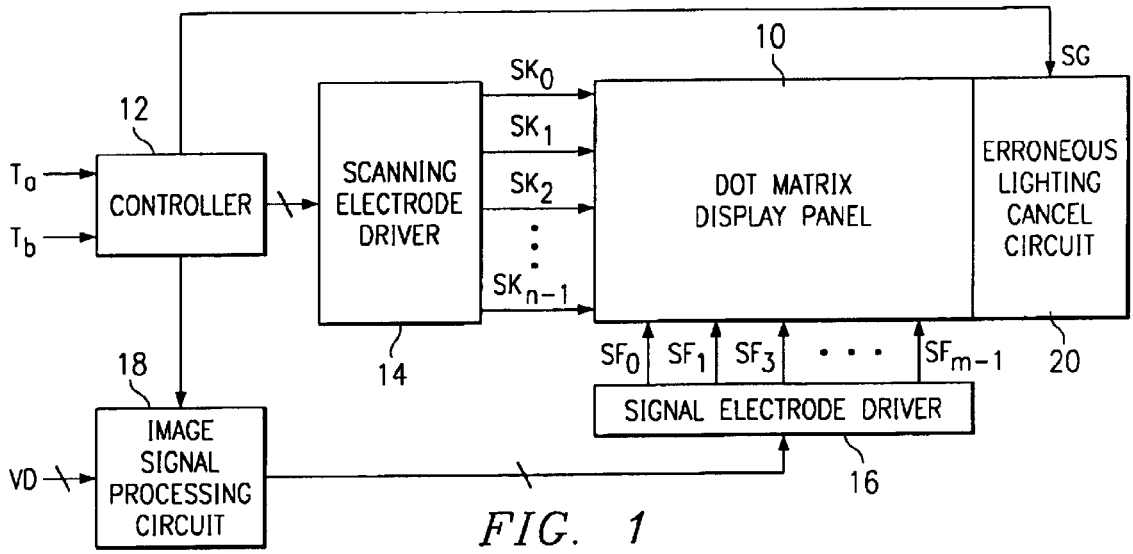
FIG. 1 is a block diagram showing the construction of a dot matrix display for a dynamic drive system according to one embodiment of this invention.
Figure 2:
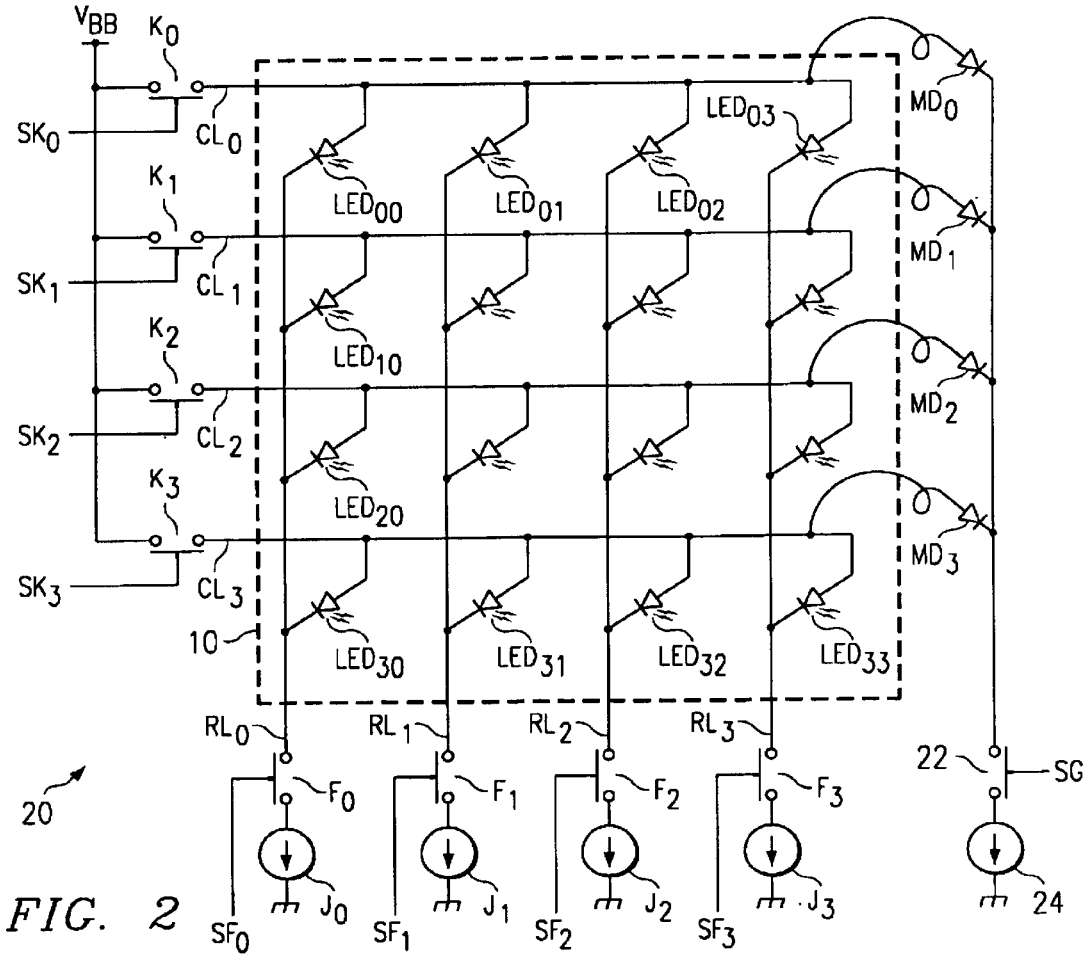
FIG. 2 is a schematic showing the construction of the essential elements in the display of the embodiment.
Figure 3:
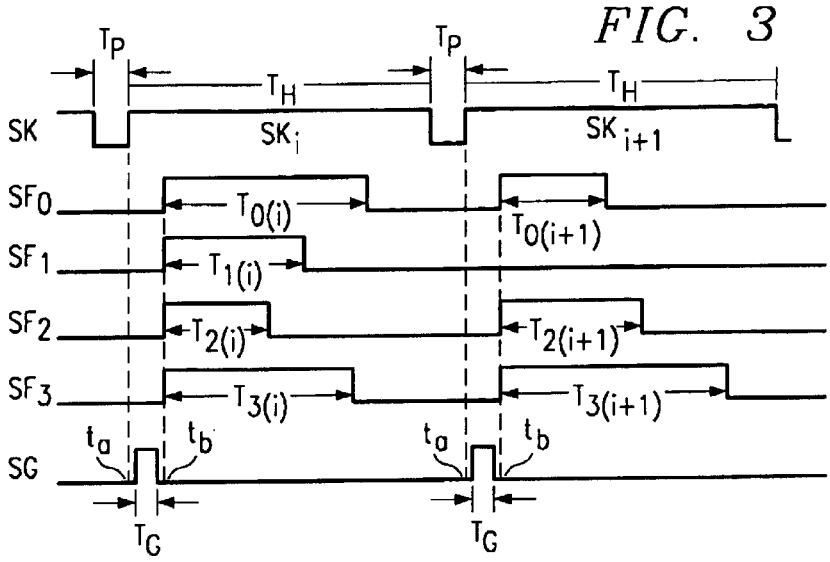
FIG. 3 shows the timing for the essential signals in the display of the embodiment.

In FIGS. 1 and 2, the construction of a dot matrix display with a dynamic drive system according to one embodiment of this invention is shown. In FIG. 3, the timing for the essential signals in this display is shown.

As in FIG. 2, the dot matrix display panel 10 can use the same device as in the past. In other words, in this display panel 10, along with the common lines CL0, CL1, CL2, CL3 arranged at a constant pitch in the vertical direction and expanding in the horizontal direction as the scanning electrodes, the signal lines RL0, RL1, RL2, RL3 are arranged at a constant pitch in the horizontal direction and expanding in the vertical direction as the signal electrodes, and LEDs (light emitting diodes) used as display elements at each intersection point of the matrix are arranged with the anodes connected to a common line CL and the cathodes connected to a signal line RL, respectively. The common lines CL0, CL1, CL2, CL3 are electrically connected to the terminal of the positive polarity power supply voltage VBB through the medium of the switches K0, K1, K2, K3. On the other hand, the signal lines RL0, RL1, RL2, RL3 are electrically connected to the ground terminal through the medium of the switches F0, F1, F2, F3 and the constant current source circuit (active loads) J0, J1, J2, J3.

The number of pixels for the display panel 10 are not related to the essence of this invention, and an example of a 4×4 matrix is shown for convenience of illustration in FIG. 2. Actually, there are also applications in which one screen is constructed by arranging a large number of panel modules of a fixed size (for example, 16×16) in a one-dimensional direction or a two-dimensional direction.

The switches K0, K1, K2, K3 used for the scanning drive are constructed so that the corresponding drive signals SK0, SK1, SK2, SK3 from the scanning electrode driver 14 can individually place them in the ON state at the time of an active state (H level). The switches F0, F1, F2, F3 used for the signal drive are constructed so that the corresponding drive signals SF0, SF1, SF2, SF3 from the signal electrode driver 16 can individually place them in the ON state at the time of an active state (H level).

During the period for one frame, the scanning electrode driver 14, under the control of the controller 12, by a time division system, for example, a line sequence scanning system, places the drive signals SK0, SK1, SK2, SK3 in an active state (H level) for a constant horizontal scanning period TH sequentially and selectively (FIG. 3). By this means, for each horizontal scanning period TH, the switches K0, K1, K2, K3 are sequentially and selectively placed in the ON state, and the power supply voltage VBB is supplied to the pertinent common line CLi through the medium of the switch Ki in the ON state.

During each horizontal scanning period TH, the signal electrode driver 16, in response to a video signal, for example, a gradation signal, for one horizontal line portion from the image signal processing circuit 18, places the drive signals SF0, SF1, SF2, SF3 by means of, for example, a pulse width control system, in an active state (H level) for just time or pulse widths T0(*i*), T1(*i*), T2(*i*), T3(*i*) corresponding to the gradation value of the respective corresponding signal (FIG. 3).

By this means, during each horizontal scanning period TH, each LEDi0,LEDi1, LEDi2, LEDi3 for one line portion that is connected to the selected common line CLi is made to emit light (to light) by conducting a constant current for just the ON time T0(*i*), T1(*i*), T2(*i*), T3(*i*) for each corresponding switch F0, F1,F2, F.

A characteristic component in this embodiment is the erroneous lighting cancel circuit 20 that is provided abutting the display panel 10. As is shown in FIG. 2, this erroneous lighting cancel circuit 20 has a number of (or assemblies of) dummy diodes MD used for erroneous lighting prevention equal to the number of common lines CL, and along with electrical connection by means of suitable wiring from the anode of each dummy diode MD0, MD1, MD2, MD3 to each corresponding common line CL0, CL1, CL2, CL. The cathode of each dummy diode MD0, MD1, MD2, MD3 is electrically connected to the terminal for a reference potential, for example, ground potential, through the medium of a common switch 22 and a constant current source circuit (active load) 24. The switch 22 and the constant current source circuit 24 can be constructed by, for example, one bipolar transistor and one load resistor.

In the erroneous lighting cancel circuit 20, a control signal SG from a controller 12 is applied to a switch 22. This control signal SG is in an active state (H level) just the prescribed time TG that is set between the starting time ta for each horizontal scanning period TH and the time of increase tb for each drive signal (FIG. 3), and places the switch 22 in the ON state. During this prescribed time TG, the positive electrical charge that is present on each command line CL0, CL1, CL2, CL3 is discharged by a constant current to the ground side through the medium of each dummy diode MD0, MD1, MD2, MD3, the switch 22 in the ON state, and the constant current source circuit 24.

At this time, because the signal line RL of the load side is placed in a floating state, there is no DC escape path at each LED within the display panel 10 for negative charge that is accumulated at the cathode electrode, and because of this, a positive charge that is almost equal to the negative charge remains at the anode electrode. As expected, in this way, the accumulated charge that is held at the LED is proportionally small compared to the charge required for lighting the LED, and the major portion of the positive charge on each common line CL is discharged by means of the erroneous lighting cancel circuit 20.

Also, separate from the accumulated charge of the LED, on each common line CL, a charge is also accumulated due to the line capacity and the parasitic capacity of each line. This line capacity accumulated charge is also discharged at a fixed cycle by means of the erroneous lighting cancel circuit 20.

The charge attraction characteristics (discharge characteristics) of the erroneous lighting cancel circuit 20 in relation to each common line CL is regulated by means of the threshold value VF of the dummy diode MD, the discharge time TG, and the constant current source circuit 24. It is also possible to connect the dummy diodes MD in multiple stages, and series connect resistors.

In this way, the excess positive charge that is present on each common line CL0, CL1, CL2, CL3 can be periodically (between horizontal scans) discharged by means of the erroneous lighting cancel circuit 20 without affecting the normal LED display drive. Because of this, during each horizontal scanning period TH, the switch F used for each corresponding signal drive is closed at each LED of each row that is not selected, and at the time the negative charge that is accumulated at that cathode has shifted to the ground side through each signal line RL, the positive charge that has accumulated on the anode electrode dies out through a DC escape path, and because the quantity of this positive charge is reduced due to the above-mentioned discharge (cancel) operation, there is no conductance (erroneous lighting) by each LED.

On the other hand, during each horizontal scanning period TH, at each LED of the row that has been selected, because each corresponding common line CL of the anode side is supplied with electricity by the power supply voltage VBB, the switch F used for each corresponding signal drive of the cathode side is put in an ON state for just the time or pulse width corresponding to each signal, and by means of lighting by conducting at a constant current for just that ON time, performs the desired gradation display.

In the erroneous lighting cancel circuit 20 of this embodiment, a switch 22 is provided in series with the string of dummy diodes MD0, MD1, MD2, MD3, and by turning the switch 22 ON between the horizontal scans, the excess positive charge on each command line CL0, CL1, CL2, CL3 is periodically discharged to the ground.

However, as one modified example, it is also possible to omit the switch 22, and steadily discharge the surplus positive charge on each common line CL0, CL1, CL2, CL3 to the ground. However, in that case, because the positive charge is discharged by means of the erroneous lighting cancel circuit 20 even when each common line CL0, CL1, CL2, CL3 is selected (driven), to that extent, electrical power is wastefully consumed.

Also, in the above-mentioned embodiment, a constant source current circuit 24 is provided in the erroneous lighting cancel circuit 20, the discharge current is stabilized immediately after the switch 22 is turned ON, and by this means, a sudden voltage drop on each common line CL, and by extension, an excessive reverse voltage on each LED, can be effectively prevented. However, the omission of the constant current source circuit 24 is also possible in response to requirements.

Although the number of components becomes large, a construction is also possible in which a switch 22 and/or a constant current source circuit 24 is provided at each dummy diode MD0, MD1, MD2, MD3. In that case, it is possible to conduct the discharge operation for each common line CL0, CL1, CL2, CL3 at their respective individual timing, for example, the discharge operation can also be conducted with any time for the non-selected common lines even during the horizontal scanning period TH.

Also, in the above-mentioned embodiment, the dummy diodes MD0, MD1, MD2, MD3 used for erroneous lighting cancellation are provided outside the display panel 10, and by this means, all of the LEDs within the display panel 10 can function as display elements.

Figure 4:
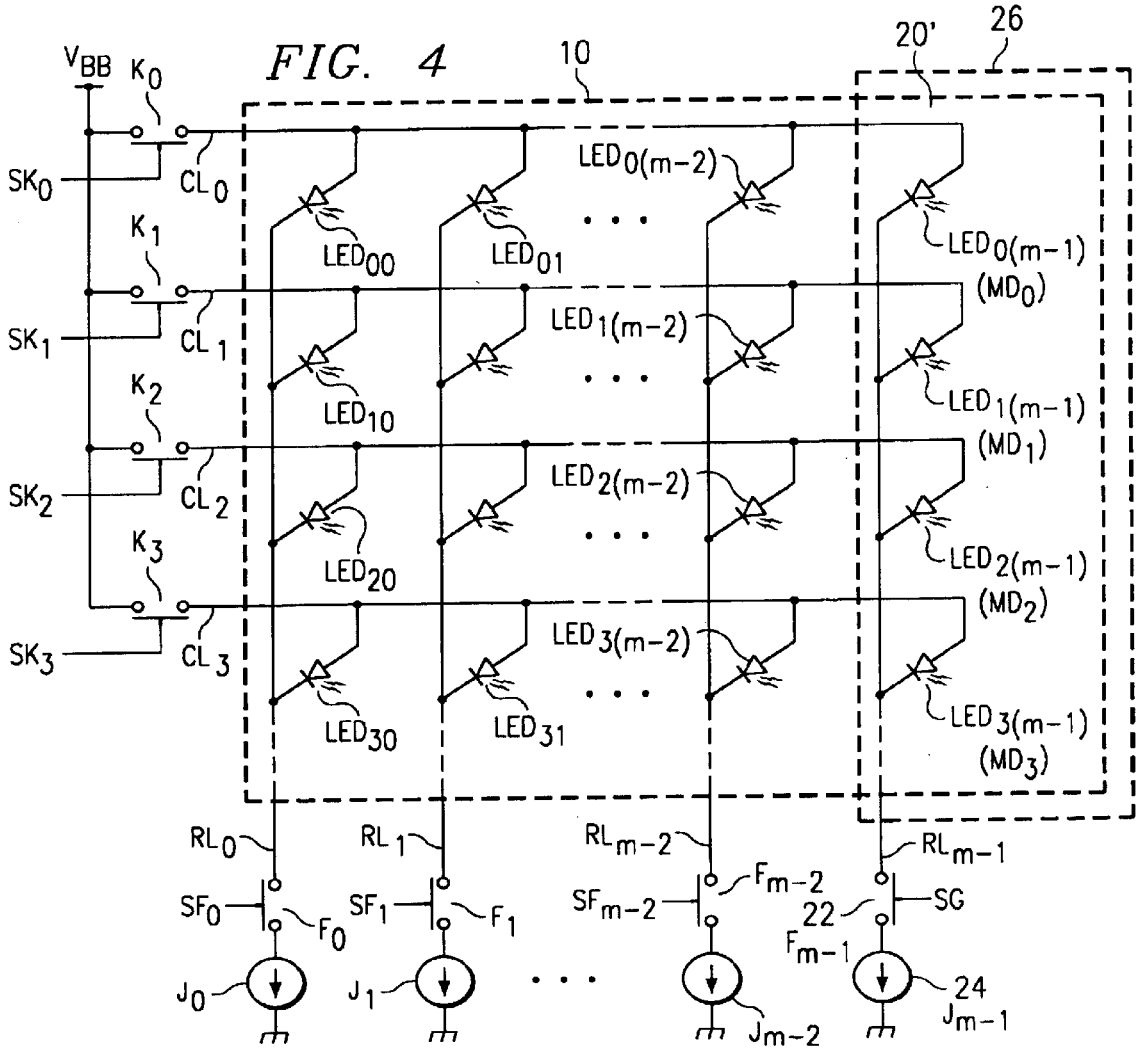
FIG. 4 is a schematic showing the construction of an erroneous lighting cancel circuit according to one modified example of the embodiment.
Figure 7:
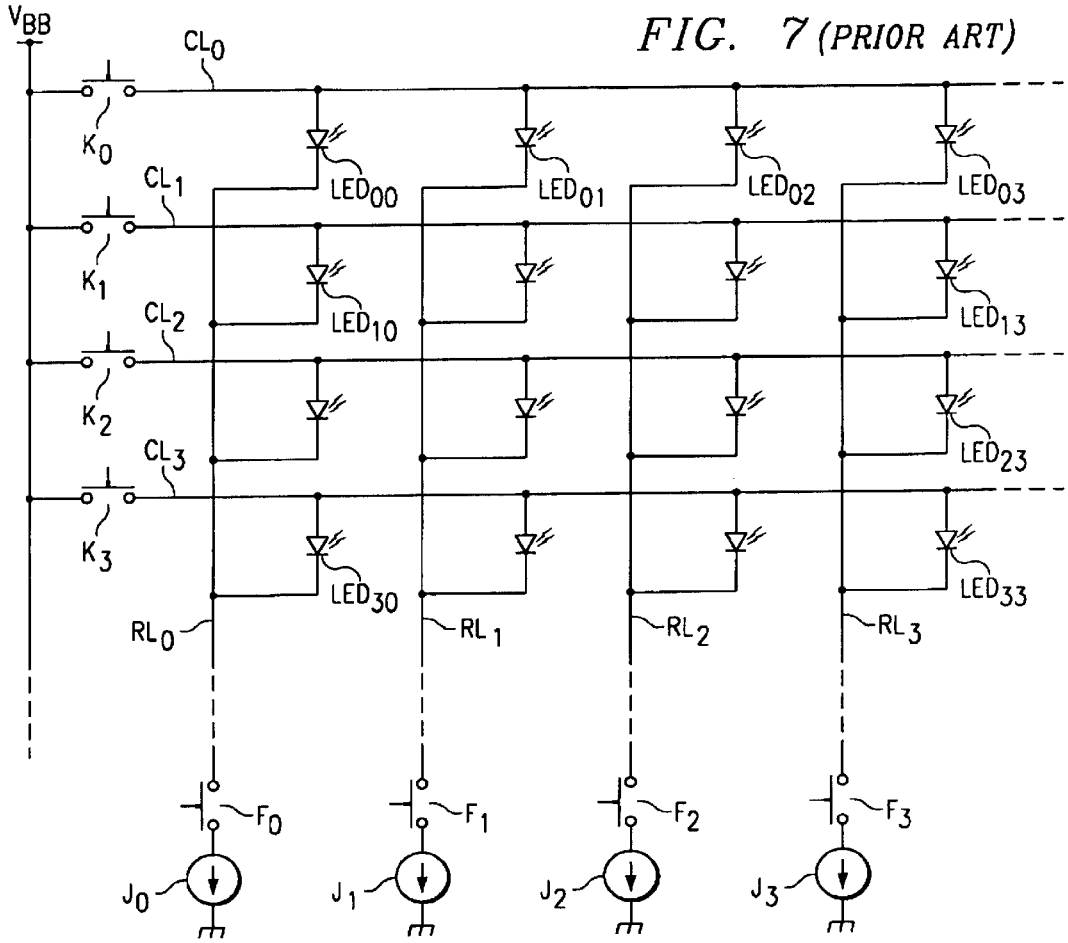
FIG. 7 (PRIOR ART)
FIG. 7 is a schematic showing the basic construction of a dot matrix display.
Figure 8:
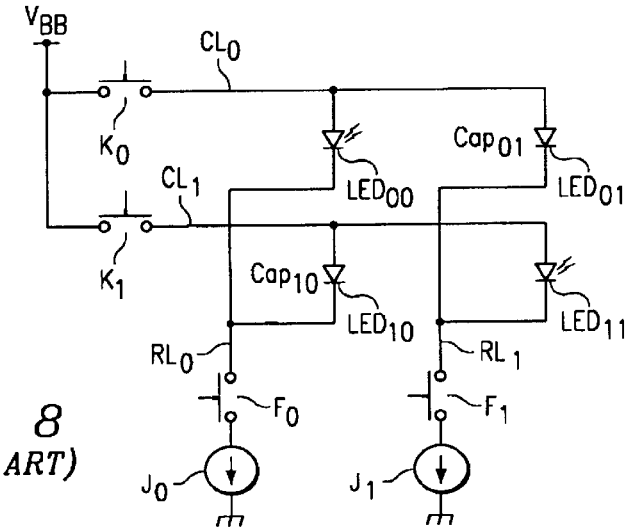
FIG. 8 (PRIOR ART)
FIG. 8 is a circuit diagram of a model for the purpose of explaining the problem points of the prior art.

However, in one portion inside the display panel 10, for example, as is shown in FIG. 4, it is also possible to fill in the LED0(*m*-1), LED1(*m*-1), LED2(*m*-1), LED3(*m*-1) for one edge column with the dummy diodes MD0, MD1, MD2, MD3. In that case, a switch Fm-1 used for the signal drive is used as the switch 22 for the above-mentioned discharge operation control, and a discharge current source circuit Jm-1 used for the signal drive can be used as the constant current source circuit 24 for the above-mentioned discharge current control. In this construction example, the LED0(*m*-1), LED1(*m*-1), LED2(*m*-1),LED3(*m*-1) used for dummies emit light during discharge, but the area for this portion can be covered by a light barrier material 26, and can be made a non-display region.

Figure 5:
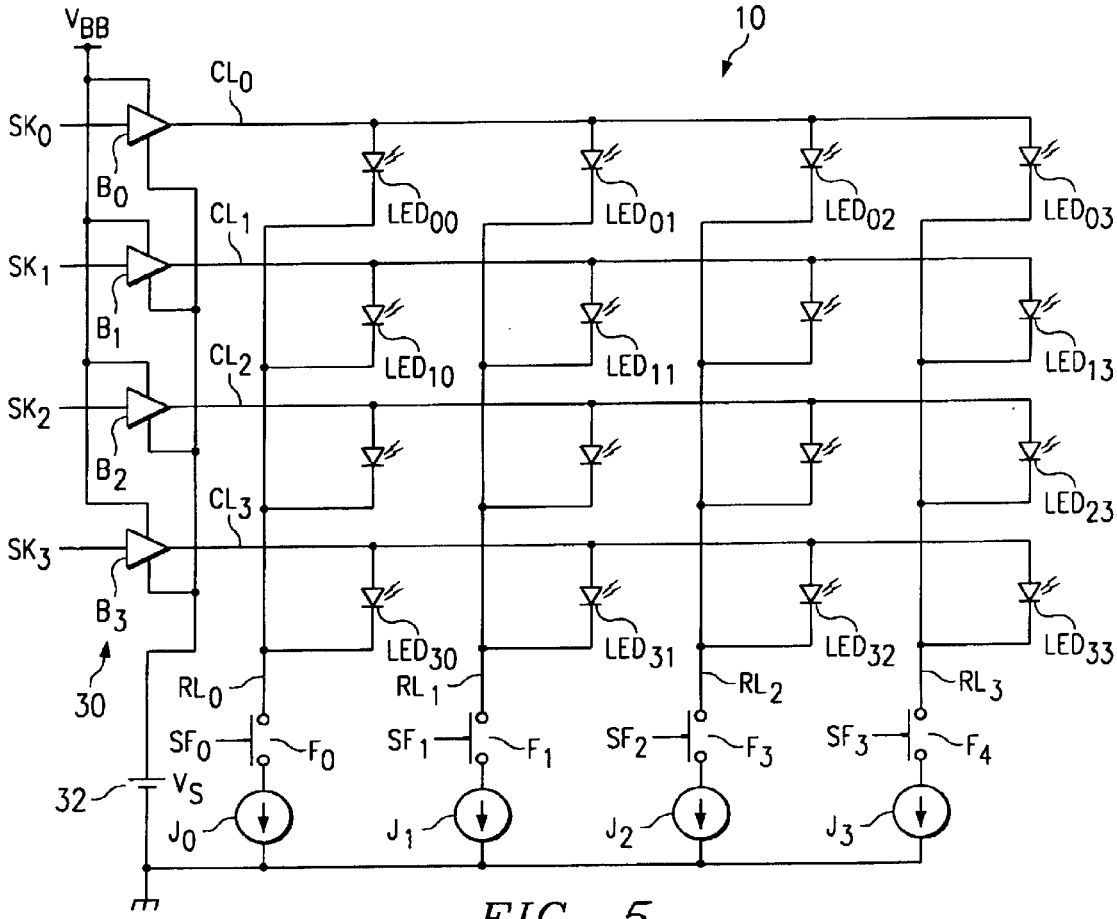
FIG. 5 is a schematic showing the construction of the essential elements in a display of another embodiment.
Figure 6:
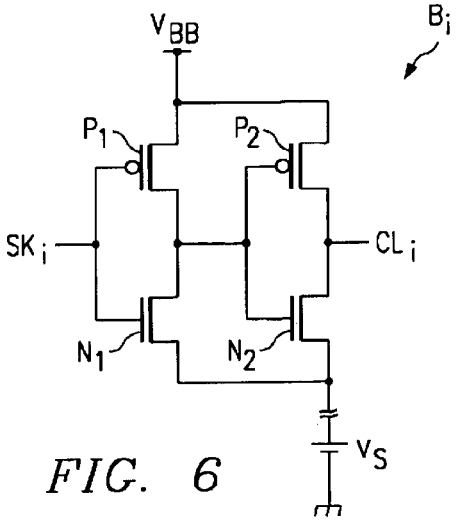
FIG. 6 is a schematic showing the construction of a buffer circuit that is used in the embodiment of FIG. 5.
Figure 2A:
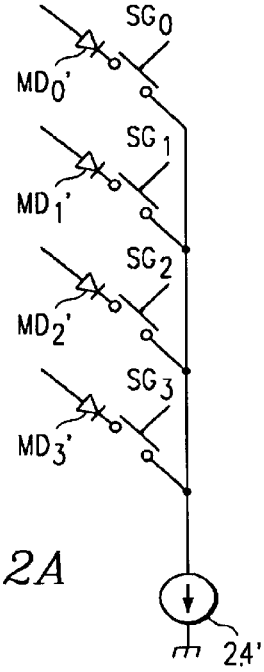
FIG. 2A is a schematic drawing of an alternate embodiment of the circuit shown in FIG. 2.

An erroneous lighting cancel circuit according to another embodiment of this invention is shown in FIGS. 5 and 6. As shown in FIG. 5, this erroneous lighting cancel circuit 30 does not use dummy diodes, and in place of those, provides the scanning electrode driver 14 (FIG. 1) and the buffer circuits B0, B1, B2, B3 between each common line CL0, CL1, CL2, CL3, and the positive polarity voltage terminal of each buffer circuit Bi is connected to the power supply voltage VBB used for the common line drive, and the negative polarity voltage terminal of each buffer circuit Bi is connected to a DC power supply 32 that provides a positive polarity voltage Vs that is a prescribed value higher than the ground potential.

As shown in FIG. 6, each buffer circuit (Bi) consists of two stages of CMOS converters P1, N1, P2, N2 that are cascade connected. During the period that a pertinent common line CLi is selected (horizontal scanning period), a control signal SKi from the scanning electrode driver 14 is at the H level and the PMOS transistor P1=OFF, the NMOS transistor N1=ON, the PMOS transistor P2=ON, the NMOS transistor N2=OFF, and the terminal of the power supply voltage VBB is electrically connected to the common line CLi through the medium of P2.

In the interval the pertinent common line CLi is not selected, the control signal SKi is held at the L level and P1=ON, N1=OFF, P2=OFF, N2=ON, and the positive polarity voltage Vs of the power supply 32 is electrically connected to the common line CLi through the medium of N2. Here, because the voltage Vs of the power supply 32 is set to a level that is considerably lower than the power supply voltage VBB, the excess positive charge that is present on the common line CLi is attracted to the power supply 32 through the medium of N2. As expected, if the voltage Vs of the power supply 32 is too low, an excessive inverse voltage is applied to each LED within the display panel 10, and breakdown is a concern. Because of that, it is necessary that the voltage Vs of the power supply 32 be set to a sufficient level.

In the above-mentioned embodiment, a construction is used wherein light emitting diodes (LEDs) are used as display elements for the display panel 10, the common lines CL used for the scanning drive are connected to the anodes of the LEDs, and the signal lines RL used for signal drive are connected to the cathodes of the LEDs. However, even if a construction is used wherein the polarities of the drive voltages on the common lines CL and the signal lines RL are inverted, and the electrodes polarities) of the LEDs are reversed in relation to both of the lines CL, RL, the same type of operating effects can be obtained.

In the above-mentioned embodiments, the display gradation for each display is controlled by the drive time (pulse width) in response to each corresponding signal. However, other display gradation control systems are also possible, for example, it is also possible to obtain the display gradations by means of variably controlling the voltage, the amount of current, or the like, that is applied to each display element.

It is also possible to use display elements other than LEDs. Theoretically, a capacitive display element exists that operates equivalently as a condenser during non-display periods, and as long as it is a device in which the discharging of accumulated charge during the non-display period is desirable (or even if discharge does not occur, it does not matter), this invention can be applied to any display elements. Also, the display element in this invention is not limited to a luminescent element that emits light itself, such as the LED in the above-mentioned embodiments, and even the use of a transmissive display element such as one that passes a backlight that becomes a transmissive element when driven is also possible.

As explained above, according to the dot matrix display device of this invention, in the scanning of a dynamic drive system, the erroneous display of display elements that are connected to the scanning electrodes during non-selection is effectively prevented, and the display quality can be improved.

What is claimed is:

1. In a dot matrix display having a plurality of scan lines and a plurality of signal lines arranged in matrix form and a plurality of display elements, one display element coupled between each scan line and signal line at an intersecting point, a circuit to reduce erroneous activation of the display elements comprising;

a reduced voltage source having an output voltage less than a voltage used to drive the display elements;

a discharge circuit for coupling each of the scan lines to the voltage used to drive the display elements and to the reduced voltage source at a time when none of the signal lines is activating the display elements, whereby charge accumulating at the display elements is discharged to reduce erroneous activation of the display elements.

2. The display of claim 1 wherein the dot matrix display is a light emitting diode (LED) display.

3. The display of claim 2 wherein the discharge circuit comprises a plurality of LEDs, one of the LEDs being coupled between each scan line and the reduced voltage source for discharging charge accumulating on each of the LEDs and on the scan line.

4. The display of claim 3 wherein the discharge circuit further comprises a switch coupled between one electrode of each of the LEDs and the reduced voltage source.

5. The display of claim 4 wherein the plurality of LEDs is arranged in one column of the dot matrix display, the LEDs of the one column being covered so as not to form a visible part of the display.

6. The display of claim 4 wherein the reduced voltage source is at a reference potential.

7. The display of claim 3 wherein the discharge circuit further comprises a current source coupled between each switch and the reduced voltage source.

8. The display of claim 7 wherein the reduced voltage source is at a reference potential.

9. The display of claim 1 wherein the discharge circuit further comprises a plurality of scan line buffer circuits each coupling one of the scan lines to the reduced voltage source when not driving the display element.

10. The display of claim 9 wherein each of the buffer circuits couples the respective scan line to a driving voltage source when it is driving the display element.

11. The display of claim 1 wherein the reduced voltage source is at the reference potential.

12. The display of claim 1 wherein the display elements are discharged between the start of each horizontal scanning period and a time of increase for each drive signal.

13. In a dot matrix display having a plurality of scan lines and a plurality of signal lines arranged in matrix form a plurality of display elements, one display element coupled between each scan line and signal line at an intersecting point, a circuit to reduce erroneous activation of the display elements comprising;

a reduced voltage source having an output voltage less than a voltage used to drive the display elements;

a discharge circuit for coupling each of the scan lines to the voltage used to drive the display elements and to the reduced voltage source at a time when one of the signal lines is not activating display elements, whereby charge accumulating at the display elements is discharged to reduce erroneous activation of the display elements;

wherein the discharge circuit comprises a plurality of light emitting diodes (LEDs), one LED being coupled between each scan line and the reduced voltage source for discharging charge accumulating on each of the LEDs and on the scan line, and wherein the discharge circuit comprises a plurality of switches, one of the switches being coupled between each of the LEDs and the reduced voltage source.

14. The display of claim 13 wherein the discharge circuit further comprises a current source coupled between each of the switches and the reduced voltage source.

15. The display of claim 13 wherein the reduced voltage source is at a reference potential.

* * * * *